US006662797B1

(12) United States Patent
Freeman et al.

(10) Patent No.: US 6,662,797 B1
(45) **Date of Patent: *Dec. 16, 2003**

(54) TRANSPARENT GUN ELEMENTS

(75) Inventors: Samuel Jared Freeman, Flossmor, IL (US); Brian Sullivan, Alta Loma, CA (US)

(73) Assignee: Pursuit Marketing, Inc., Des Plaines, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/723,584

(22) Filed: Nov. 27, 2000

(51) Int. Cl.[7] ..... F41B 9/00
(52) U.S. Cl. ..... 124/83
(58) Field of Search ..... 124/83

(56) References Cited

U.S. PATENT DOCUMENTS 2,416,712 A * 3/1947 Parker ..... 42/76.01
4,132,214 A * 1/1979 Schnurr et al. ..... 124/1
4,436,077 A * 3/1984 Smith ..... 124/1
4,586,715 A * 5/1986 Scolari et al. ..... 273/DIG. 24
4,598,491 A * 7/1986 Noble ..... 42/58
4,834,269 A * 5/1989 Cone ..... 220/771
5,090,602 A * 2/1992 Link ..... 222/159
5,092,808 A * 3/1992 Takasaka et al. ..... 446/178
5,257,614 A * 11/1993 Sullivan ..... 124/73
5,339,791 A * 8/1994 Sullivan ..... 124/73
5,507,271 A * 4/1996 Actor ..... 124/56
5,771,875 A * 6/1998 Sullivan ..... 124/72
6,295,752 B1 * 10/2001 Havlock ..... 42/76.01

* cited by examiner

*Primary Examiner*—Charles T. Jordan
*Assistant Examiner*—Jordan Lofdahl
(74) *Attorney, Agent, or Firm*—Altheimer & Gray; Michael G. Kelber; Michael A. Carrillo

(57) ABSTRACT

The invention provides a barrel for a gun having a portion comprising a substantially transparent material. The barrel can be made of any substantially transparent material including a polycarbonate or glass, such as tempered glass. The barrel is coated with a substantially transparent material to add hardness, which provides scratch resistance, and prevent deterioration of the substantially transparent material. A barrel assembly is constructed by attaching the barrel to a gun housing, also called a barrel cage, comprised of a stiff material, for example metal such as aluminum. In another aspect of the invention, an expansion chamber is provided having a housing with a portion comprising a substantially transparent material, such as a polycarbonate or glass, such as, tempered glass. The housing is coated with a substantially transparent material to reduce scratching and absorption of pressurized gas into the transparent material. The housing is partially enclosed within a cage to provide additional protection and stiffness to the expansion chamber.

15 Claims, 11 Drawing Sheets

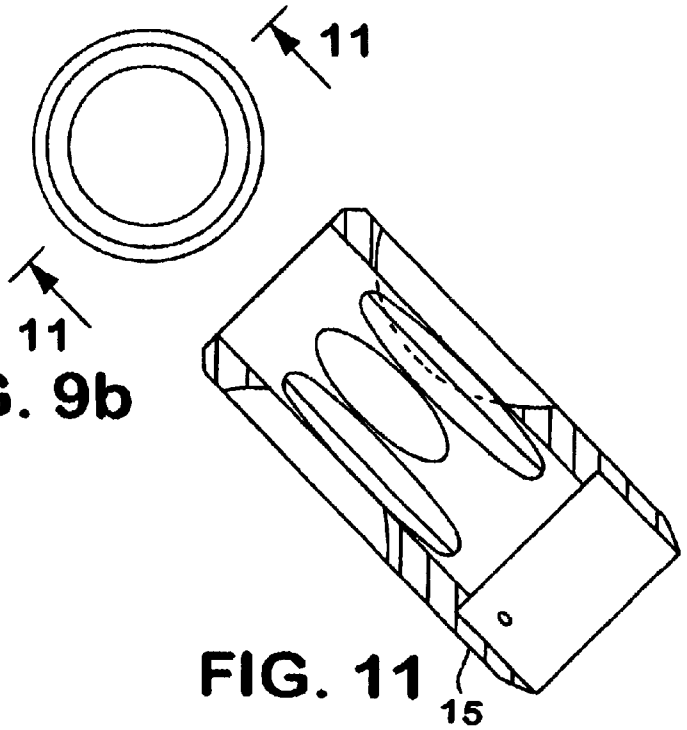
FIG. 9b
FIG. 11
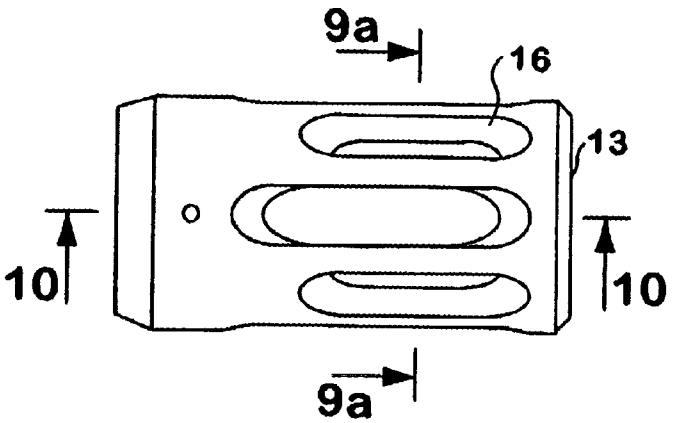
FIG. 9
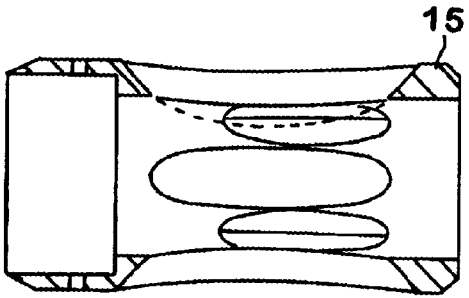
FIG. 10
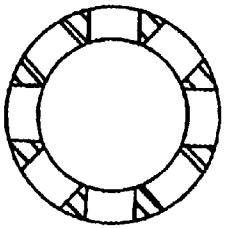
FIG. 9a

TRANSPARENT GUN ELEMENTS

FIELD OF THE INVENTION

The present invention relates to guns, including guns for use in the sport of paintball.

BACKGROUND OF THE INVENTION

Conventional firearms have a firing mechanism to fire a projectile and a barrel to direct the projectile in a desired direction. Guns are made for numerous purposes and include many designs, for example, rifles, shot guns, and hand guns. Guns are designed to use many different mechanisms for firing a projectile. For example, one type of gun is dependant on having a propellant combined with the projectile. In this type of gun, the firing mechanism detonates the propellant contained in the projectile, which launches the projectile along the barrel. This type includes shot guns, which fire cartridges comprised of shot packaged with explosive material, and conventional rifles, machine guns, and handguns, which shoot bullets comprised of a unitary slug packaged with explosive material in a casing.

Another method of firing a projectile uses a propulsion source separate from the projectile, such as compressed gas, including air, carbon dioxide, nitrogen, and others. Examples of such guns include, air riffles, BB guns, and paintball guns or "markers." These guns either include a pump for compressing ambient air or are adapted to receive compressed air from a source, such as a compressed gas cartridge or gas cylinder. Conventional paintball guns rely on such cartridges or gas cylinders for supplying compressed gas, including air, nitrogen and carbon dioxide.

The introduction of debris into the firing mechanism or barrel of any firearm can affect the ability of the firearm to fire a projectile and affect the accuracy of the shot. For example, debris can jam the firing mechanism or debris can deflect or obstruct the path of a projectile within the barrel.

In the case of paintball guns, the projectile is a paintball, which is a volume of paint encased in a spherical shell comprised of a breakable casing. The paintball is designed to explode upon impact against an intended target, but occasionally paintballs inadvertently break prematurely prior to impact, and can even burst while loading or firing within the paintball gun. Paint residue from an exploded paintball remaining inside the paintball gun typically inhibits the trajectory and speed of later-fired paintballs and can even jam the paintball gun. If a paintball gun is able to continue firing after an inadvertent paintball bursts within the paintball gun, it is not always immediately apparent that paint residue resides in the paintball gun. The failure to realize that paint residue remains within the paintgun including the paintgun barrel, can result in misfired or misdirected shots until the residue is removed from the paintgun.

As a propellant, conventional paintguns employ compressed gas, which often remains in a partially liquid state, for example, in the case of carbon dioxide. In many paintball guns, a gas cylinder is attached to the gun in a substantially horizontal position. In this position, liquid compressed gas can flow into the gun's firing mechanism. Even when the compressed gas cylinder is not configured in a horizontal position with respect to the paintball gun, liquified gas can inadvertently enter the firing mechanism during game play when the paintball gun is being carried in various positions. Because compressed gas in a liquid state occupies a smaller volume than when it is in a gas state, the entry of liquified gas into the firing mechanism (known as "going liquid") can have the undesired effect of allowing too much gas into the gun's expansion chamber, resulting in a gun that fires under excessive pressure, sometimes referred to as a "hot" gun. A hot gun is more likely to prematurely rupture a paintball and can also injure a participant who is hit with a paintball traveling at excessive speed.

One method used to inhibit the entry of liquified gas into the firing mechanism of a paintball gun is to provide an expansion chamber in communication between the compressed gas source and the firing mechanism. Such an expansion chamber provides a volume within which liquified gas can evaporate prior to entering the paintball gun, particularly the firing mechanism. Commonly, such expansion chambers are equipped with a plurality of baffles to further inhibit the passage of liquified gas into the firing mechanism. Even with a gun suited with an expansion chamber, liquified gas can enter the firing mechanism of a paintball gun. For example, during game play, the paintball gun may be held in a downward position with the expansion chamber below the gas cylinder, allowing gravity to fill the expansion chamber with liquified gas. Accordingly, it is desirable to ascertain whether liquid occupies the expansion chamber before firing the paintball gun.

The present invention solves the foregoing and other problems in the art and satisfies the industry demands.

SUMMARY OF INVENTION

It is an object of the invention to provide a barrel for a gun having a portion comprising a substantially transparent material. The barrel can be made of any substantially transparent material, but in one embodiment the material is a polycarbonate. Other suitable materials for the barrel include glass, such as tempered glass.

In another aspect of the invention, the barrel is coated with a substantially transparent material to add hardness, which provides scratch resistance, and prevents deterioration of the polycarbinate from the absorption of dyes from paintballs and solvents used to clean the gun.

In another aspect of the invention, a barrel assembly is constructed by attaching the barrel to a barrel cage comprised of a stiff material, for example, metal such as aluminum. The barrel cage provides protection to the barrel and also creates a desirable appearance.

In another aspect of the invention, an expansion chamber is provided having a housing with a portion comprising a substantially transparent material. The expansion chamber is comprised of a base, a cover, and a housing between the base and the cover. The expansion chamber includes an inlet for accepting compressed gas and an outlet for discharging compressed gas.

In another aspect of the invention, the expansion chamber housing is comprised of a polycarbonate. In another aspect of the invention, the housing is comprised of glass, specifically, tempered glass. In yet a further aspect of the invention, the housing is coated with a substantially transparent material to reduce scratching and absorption of pressurized gas into the transparent material.

In another aspect of the invention, the housing is partially enclosed within a cage to provide additional burst protection and stiffness to the expansion chamber.

In another aspect of the invention, a plurality of baffles is disposed within the housing.

The foregoing features and advantages of the present invention will be apparent from the following more detailed description of the invention. Other features and advantages of the invention will be apparent from the following detailed description and accompanying figures.

BRIEF DESCRIPTION OF THE DRAWING

FIG. 9 is a plan view of the muzzle of the embodiment shown in FIG. 1;

FIG. 9*a* is a cross sectional view of the muzzle of the embodiment shown in FIG. 9;

FIG. 9*b* is a end view of the muzzle of the embodiment shown in FIG. 9;

FIG. 10 is a cross sectional view along the line A—A of the muzzle of the embodiment shown in FIG. 9;

FIG. 11 is a cross sectional view along the line B—B of the muzzle of the embodiment shown in FIG. 9;

DETAILED DESCRIPTION OF THE INVENTION

Figure 1:
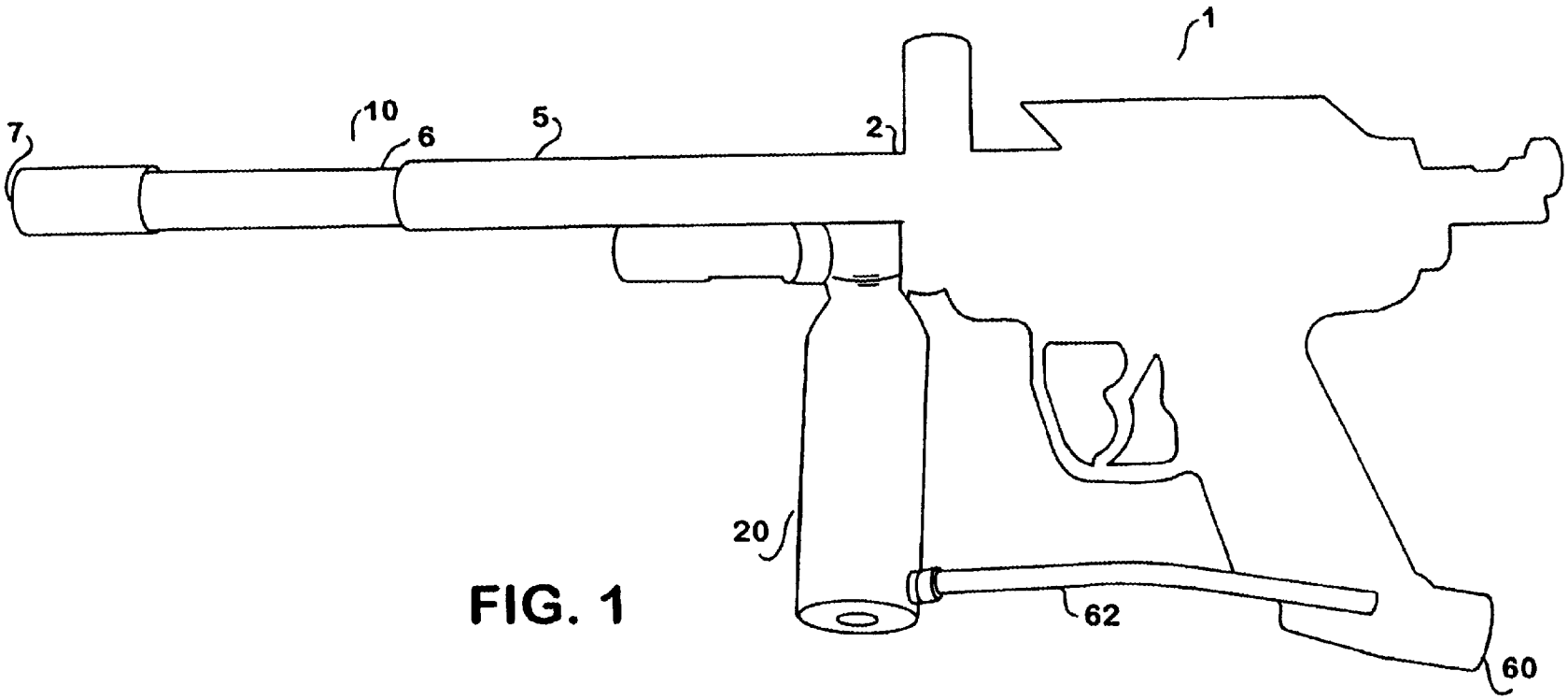
FIG. 1 is a prospective view of a paintball gun equipped with a barrel assembly and expansion chamber of the present invention.
Figure 2:
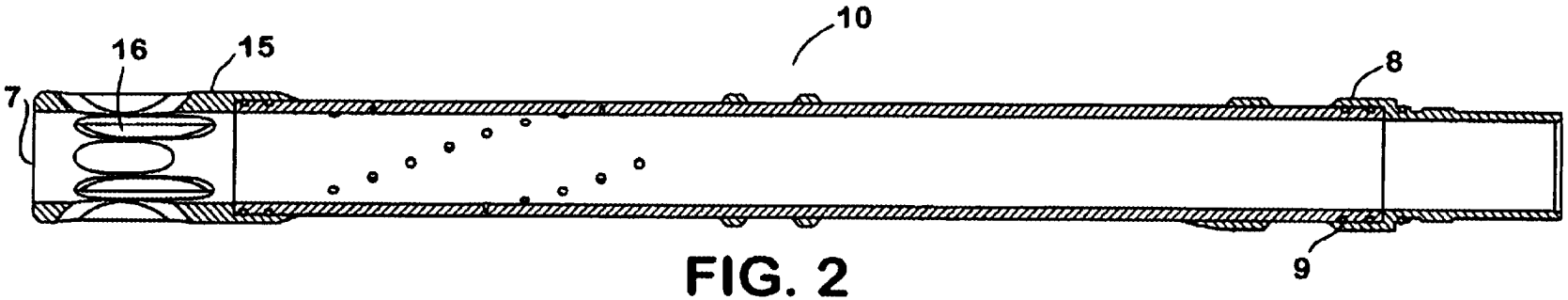
FIG. 2 is a cross sectional view of the barrel assembly of the embodiment shown in FIG. 1.

As shown in FIG. 1, gun 1 includes a barrel 5 having a portion 6 comprising a substantially transparent material. As shown in FIG. 2, the barrel 5 (also referred to as member 5) defines an axial bore 7, which is attached to a gun housing 2 containing a firing mechanism (not shown) for directing a projectile (not shown) along the axial bore 7. The barrel 5 can be made of any substantially transparent material, such that the material allows the inside of the barrel 5 to be visible to the extent that debris, for example, paint, can be seen through the barrel 5. Accordingly, a translucent material would also be substantially transparent. In one embodiment the material is a polycarbonate. Polycarbonate has desirable attributes in that it is relatively strong and stiff, thus resisting bending, crushing or other deformation of the barrel 5 that could impede or distort the trajectory of a projectile, diminishing accuracy of the gun 1. Other suitable materials for the barrel 5 include other polymers and glass. In the case of glass, it is desirable to use tempered glass, which is more durable and less prone to shattering when broken.

Certain materials, such as polycarbinate, are prone to scratching and/or absorption of paints and dyes. It has been found desirable to coat such materials with a substantially transparent material to reduce these undesirable effects. Silicon has been found to add hardness, which provides scratch resistance, and prevents deterioration of the polycarbinate from the absorption of dyes from paintballs and solvents used to clean the gun. When using tempered glass, the addition of a transparent coating such as a transparent or translucent polymer, including polyurethane, helps prevent the glass from shattering and breaking into shards.

Figure 3:
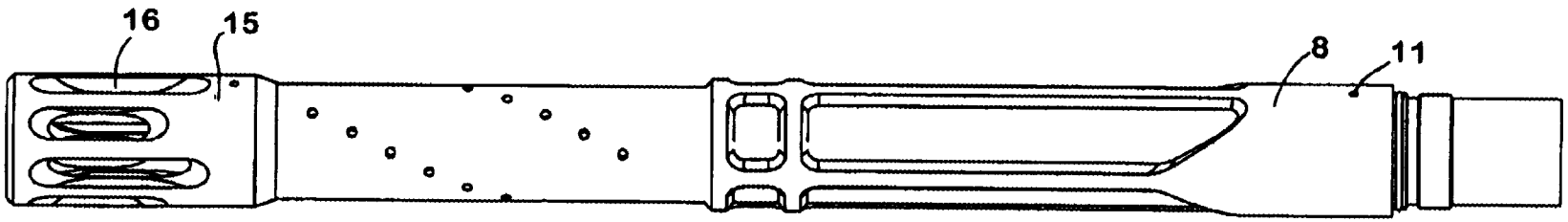
FIG. 3 is a plan view of the barrel assembly of the embodiment shown in FIG. 1.
Figure 4:
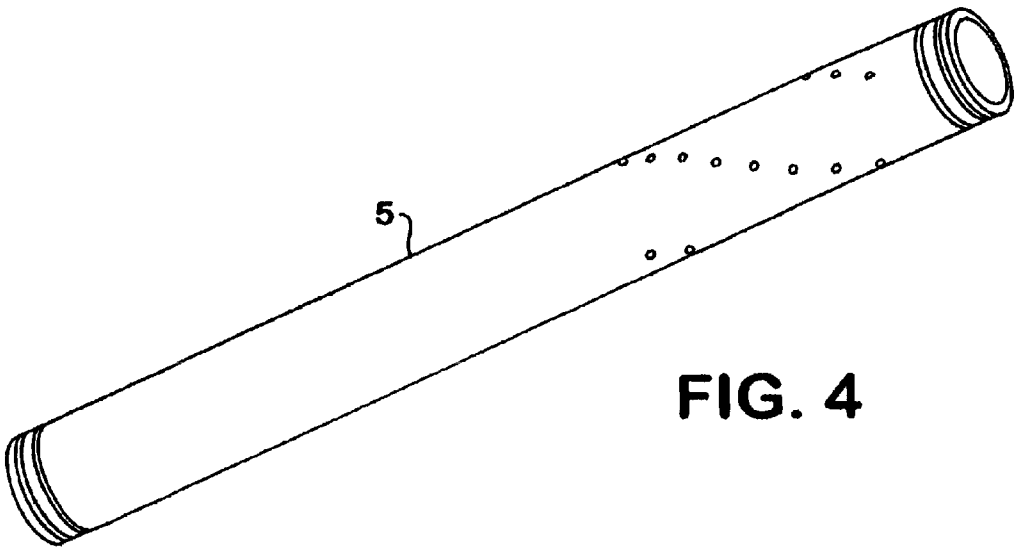
FIG. 4 is a plan view of the barrel of the embodiment shown in FIG. 1.
Figure 5:
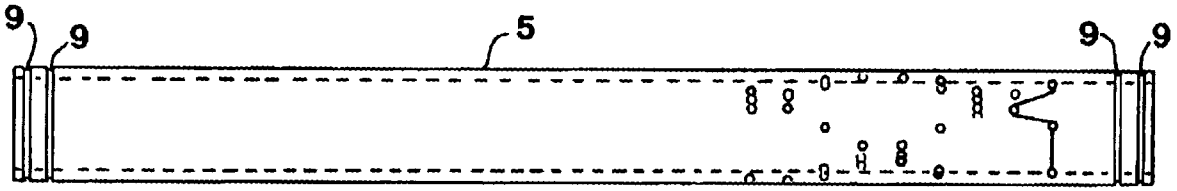
FIG. 5 is a plan view of the barrel of the embodiment shown in FIG. 1.
Figure 6:
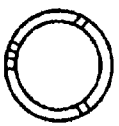
FIG. 6 is a cross sectional view of the barrel of the embodiment shown in FIG. 5.
Figure 7:
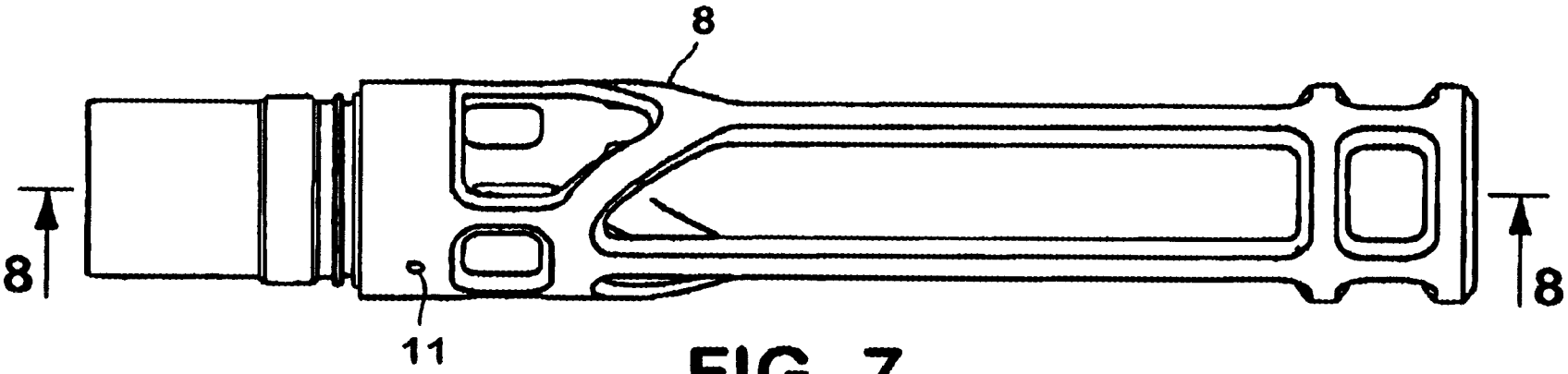
FIG. 7 is a plan view of the cage of the embodiment shown in FIG. 1.
Figure 8:
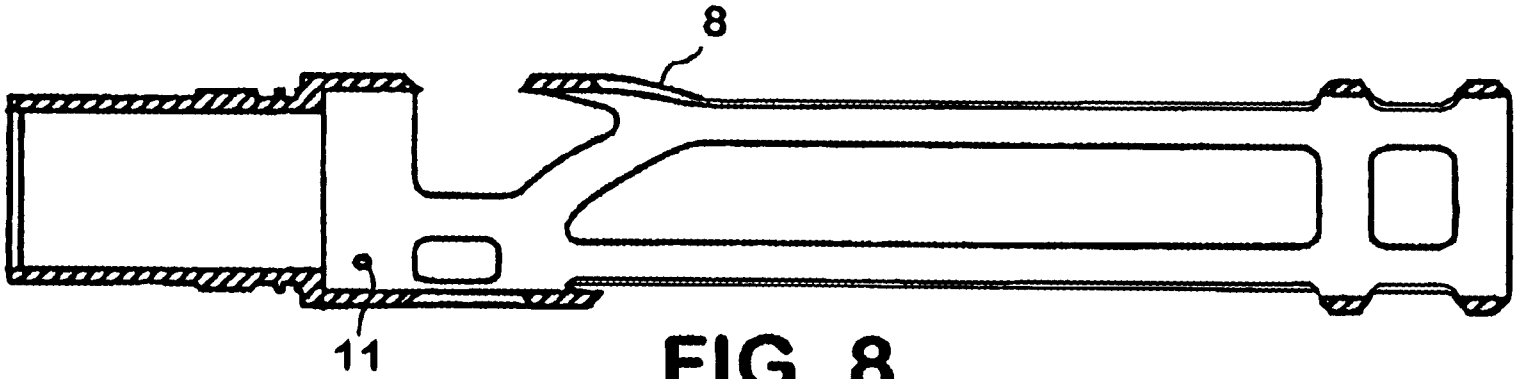
FIG. 8 is a cross sectional view of the cage of the embodiment shown in FIG. 7.

As shown in FIGS. 2 and 3, in one embodiment, a barrel assembly 10 can be constructed by attaching the barrel 5 to a cage 8. The cage 8 is comprised of a stiff material, for example metal such as aluminum. The barrel cage 8 provides protection to the barrel 5 and also creates a desirable appearance. For example, the cage 8 prevents bending, warping or crushing of the barrel 5. The cage 8 can be formed as a solid cylinder or any number of patterns may be cut in to the cage 8 to provide a desirable appearance and allow the user to view the interior of the barrel 5.

Many paintguns are adapted to allow barrel assembly 10 to be removably attached to the paintgun for cleaning, storage, shipping. In addition, after-market barrel assemblies allows users to select from various models of barrel assemblies. Conventional barrel assemblies are removably attachable by threading the barrel assembly into the gun housing. While the cage 8 is not necessary to practice the present invention, the cage 8 provides an additional advantage of being more readily removably attachable to a paintgun 1. In particular, the barrel 5 of the present invention may be directly attached to the gun housing 2, for example, by threads, adhesive, press-fitting or other methods known in the art, but by attaching the barrel 5 to the cage 8, the barrel assembly 10 provides additional durability. Constructing the cage 8 from metal, such as aluminum, rather than polycarbonate or glass, provides added strength and allows the barrel assembly 10 to be more frequently detached and attached to the paintgun 1.

In one method of construction of the barrel assembly 10, if the barrel 5 is comprised of a polycarbonate, a temperature differential can be created between the barrel 5 and the cage 8, shrinking the barrel 5 relative to the cage 8 (or expanding the cage 8 relative to the barrel 5), due to the different expansion properties of the respective materials of the barrel 5 and cage 8. Thus, the tolerance between the barrel 5 and cage 8 can be reduced, and when the temperature of both components equalize, a tight fit is created. In addition or alternatively, the barrel 5 and/or cage 8 can be adapted to define a groove 9 or cavity for receiving an adhesive. The adhesive may applied before attaching the barrel 5 to the cage 8 or the cage 8 can be adapted to contain one or more aperture 11 to accept an injection of adhesive into the groove 9. Of course many alternative methods of construction, as known to those of ordinary skill in the art, could be used to attach the barrel 5 to the cage 8, for example, threading the respective components.

In addition, the barrel assembly 10 can be fitted with a muzzle 15. In one embodiment, the muzzle 15 is comprised of aluminum, although the muzzle 15 can be constructed of any material. The muzzle 15 is formed with slots 16 or openings, which are believed to allow the escape of ambient air residing in front of a projectile in the barrel 5 immediately after a projectile is fired. The slots 16 are also believed to reduce the noise from a fired shot. The muzzle 15 may be attached to the barrel 5 by the same methods described above for attaching the barrel 5 to the cage 8.

As shown in FIG. 1, a gun 1 can be comprised having a mechanism for firing a projectile (not shown) and a barrel assembly 10 attaching to the firing mechanism for directing the projectile. The barrel assembly 10 has a portion 6 comprising a substantially transparent material. The barrel assembly 10 is comprised of a barrel 5 attached to a cage 8 and a muzzle 15.

Figure 12:
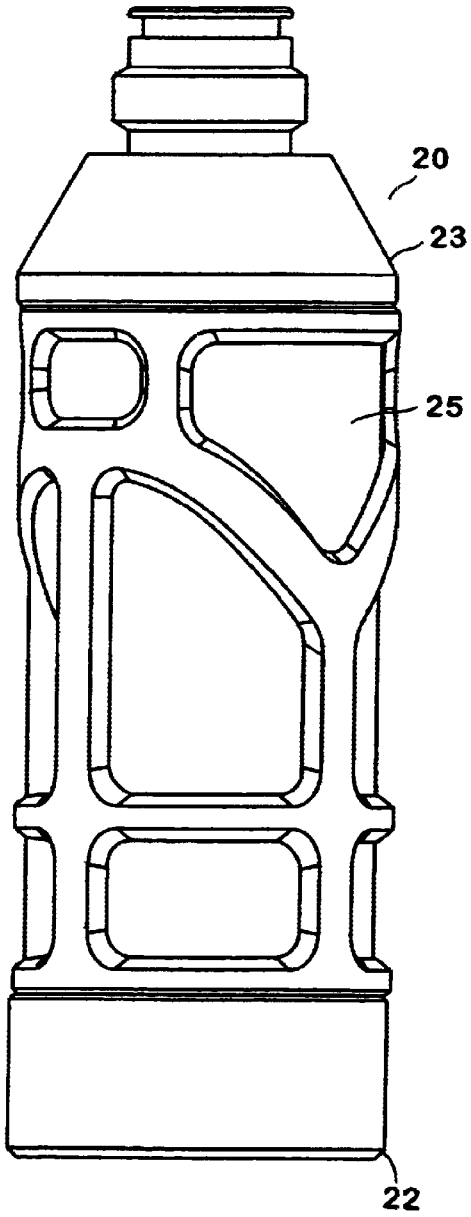
FIG. 12 is a plan view of the expansion chamber of the embodiment shown in FIG. 1.
Figure 13:
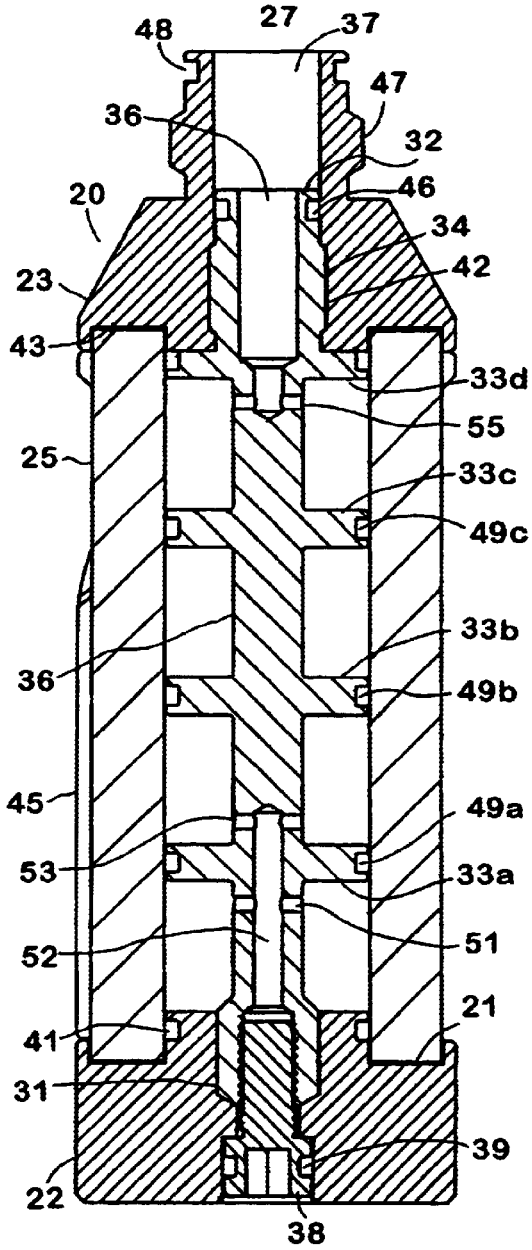
FIG. 13 is a cross sectional view of the expansion chamber of the embodiment shown in FIG. 12.
Figure 15:
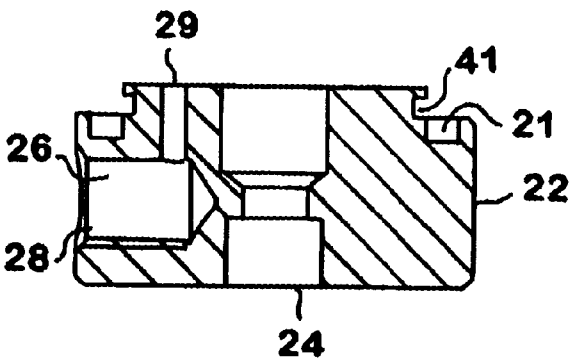
FIG. 15 is a cross sectional view of the base of the expansion chamber of the embodiment shown in FIG. 12.
Figure 14:
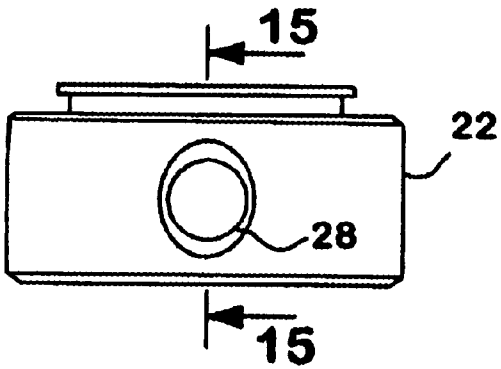
FIG. 14 is a side view of the base of the expansion chamber of the embodiment shown in FIG. 12.
Figure 16A:
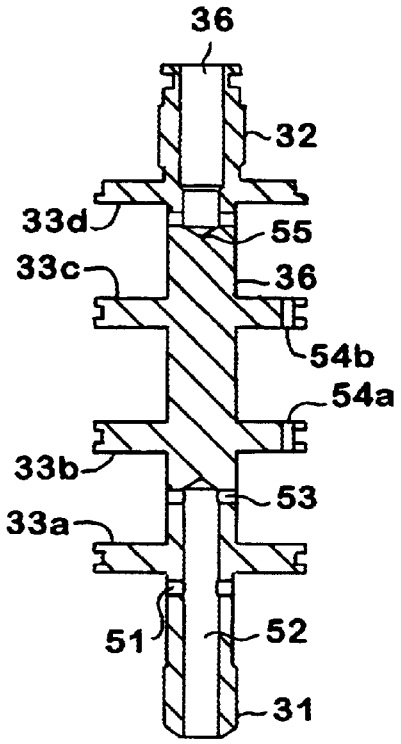
FIG. 16*a* is a cross sectional view of the baffle assembly of the expansion chamber of the embodiment shown in FIG. 13.
Figure 17:
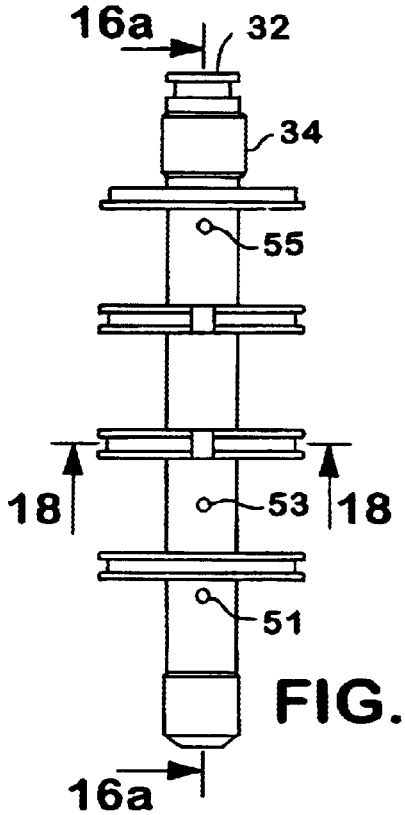
FIG. 17 is a plan view of the baffle assembly of the expansion chamber of the embodiment shown in FIG. 13.
Figure 18:
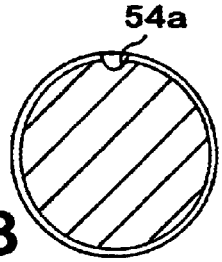
FIG. 18 is a cross sectional view along line C—C of the baffle assembly of the expansion chamber of the embodiment shown in FIG. 13.
Figure 20:
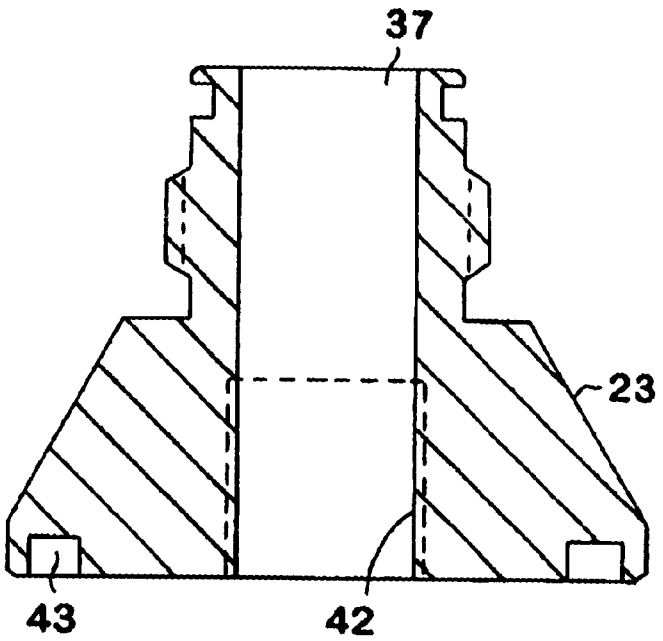
FIG. 20 is a cross sectional view along line A—A of the expansion chamber of the embodiment shown in FIG. 19.
Figure 19:
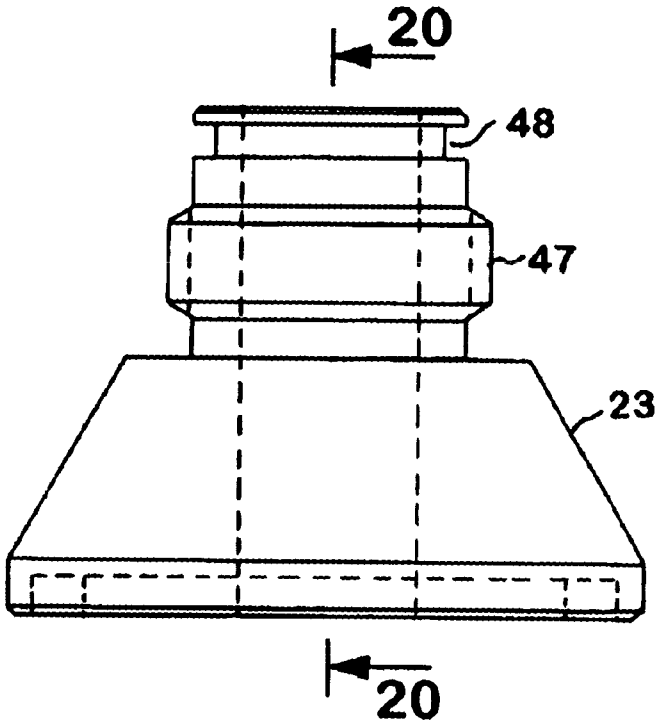
FIG. 19 is a plan view of the cover of the expansion chamber of the embodiment shown in FIG. 12.
Figure 22:
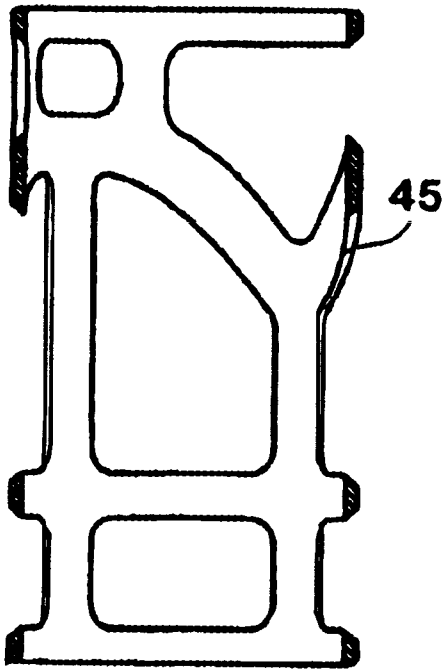
FIG. 22 is a cross sectional view along line A—A of the cage of the expansion chamber of the embodiment shown in FIG. 21.
Figure 21:
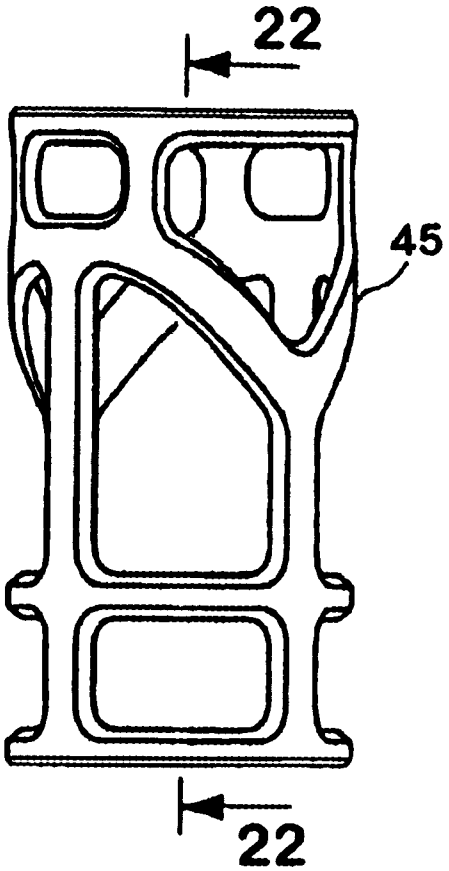
FIG. 21 is a plan view of the cage of the expansion chamber of the embodiment shown in FIG. 12.
Figure 24:
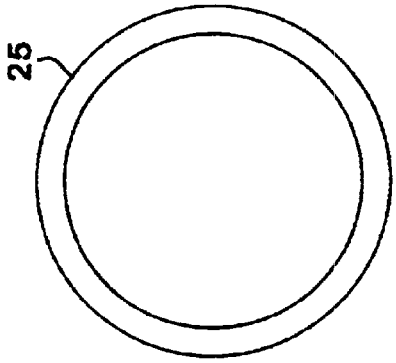
FIG. 24 is an end view of the housing of expansion chamber of the embodiment shown in FIG. 12.
Figure 23:
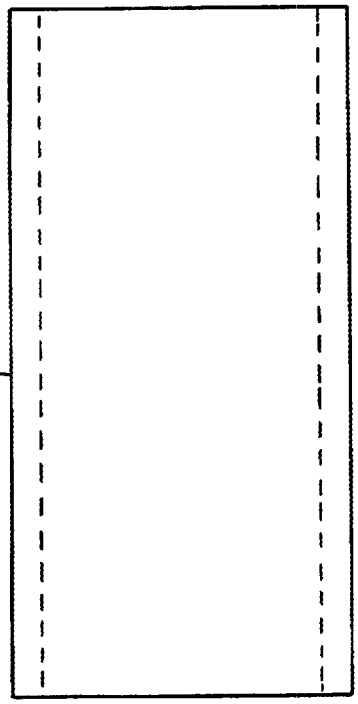
FIG. 23 is a plan view of the housing of expansion chamber of the embodiment shown in FIG. 12.
Figure 26:
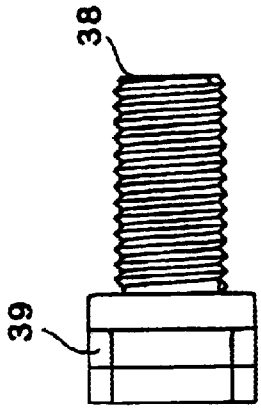
FIG. 26 is a plan view of the bolt of expansion chamber of the embodiment shown in FIG. 25.
Figure 25:
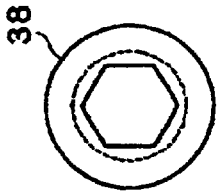
FIG. 25 is a top view of the bolt of expansion chamber of the embodiment shown in FIG. 13.

FIGS. 12 and 13 disclose an expansion chamber 20 for a compressed-gas-powered gun 1. The expansion chamber 20 is comprised of a base 22, a cover 23, and a housing 25 between the base 22 and the cover 23. The expansion chamber 20 includes an inlet 26, shown in FIGS. 14 and 15, for accepting compressed gas and an outlet 27, shown in FIG. 13, for discharging compressed gas. The inlet 26 is proximate to the base 22 and the outlet 27 is proximate to the cover 23.

The housing 25 has a portion comprising a substantially transparent material. In one embodiment, the housing 25 is comprised of a polycarbonate. In another embodiment, the housing 25 is comprised of glass, specifically, tempered glass. As discussed above, it is desirable to coat such materials with a substantially transparent material to reduce scratching. In addition, under severe pressure, as exists in a typical paintgun application, certain transparent materials, such as polycarbonate, absorb certain gases, such as carbon dioxide. Absorption of pressurized gas into the transparent material can have the further undesired effect of clouding the material, reducing the transparency of the material and detracting from the aesthetic appeal of the material. Silicon has been found to add hardness, which provides scratch resistance, and prevent absorption of dyes compressed gasses such as carbon dioxide. In addition, upon actuating a paintgun 1 with a compressed gas source, the expansion chamber 20 is under great pressure from the compressed gas. A transparent coating such as a polymer helps prevent the transparent material, such as glass, from cracking, shattering or breaking into shards, and creating a safety hazard.

As shown in FIG. 12, the housing 20 is partially enclosed within a cage 30, to provide additional protection and stiffness to the expansion chamber 20.

Figure 16:
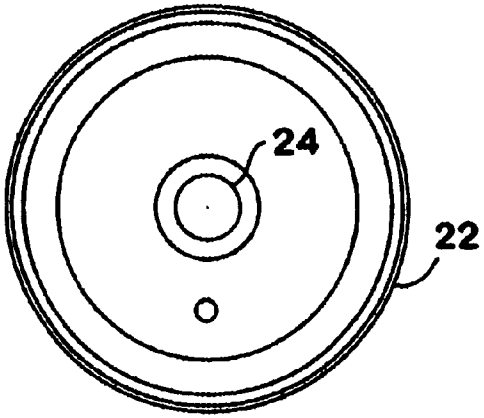
FIG. 16 is a top view of the base of the expansion chamber of the embodiment shown in FIG. 12.

As shown in FIGS. 13 and 16, one embodiment includes a plurality of baffles 33*a*, 33*b*, 33*c*, 33*d* disposed within the housing 27. The baffles 33*a*, 33*b*, 33*c*, 33*d* impede the entry of liquified gas from flowing towards the outlet 27. In one embodiment, the baffle assembly 35 comprises a plurality of baffles 33*a*, 33*b*, 33*c*, 33*d* attached to column 36. While the present embodiment discloses baffle assembly 35 comprised of a unitary component, the baffle assembly 35 could be formed of multiple components, without departing from the invention. Further, there are numerous styles and combinations of baffle assemblies known to those of skill in the art, which could be substituted for the one disclosed herein without departing from the invention.

The expansion chamber 20 is constructed as follows. The base 22 has an axial bore 24 through the base 22 for constructing the expansion chamber 20. A bore 28 is provided in the base 22, in communication with a second bore 29, which together act as an inlet 26 for compressed gas. The axial bore 24 in the base 22 is adapted to receive the first end 31 of the baffle assembly 35, which is secured to the base 22 by bolt 38. Bolt 38 is adapted to receive a sealing member 39 comprising an O-ring. The housing 25 is comprised of a cylindrical section, which is adapted to be received by an annular groove 21 in base 22. Base 22 is adapted to retain sealing member 41 comprising an O-ring to create a seal between the base 22 and the housing 25. Cage 45 slips over housing 25 and rests against base 22. Cage 45 provides additional support for the housing 25 to prevent undue expansion and possible bursting of the housing 25.

The second end 32 of baffle assembly 35 is provided with external threads 34 and an axial bore 36. Cover 23 has an axial bore 37, which acts as the outlet 27 for expansion chamber 20. Axial bore 37 further contains internal threads 42 that mate with external threads 34 of baffle assembly 35 and an annular groove 43 to receive housing 20. When baffle assembly 35 is mated to cover 23, the housing 25 and cage 30 are maintained between the base 22 and cover 23. O-ring sealing member 44 is secured between baffle assembly 35, cover 23 and housing 25, sealing all three components. O-ring sealing member 46 is disposed between baffle assembly 35 and cover 23, sealing the components. Cover 23 is further provided with external threads 47 to attach the expansion chamber 20 to the gun 1 and a groove 48 to support sealing member (not shown) for sealing the connection between the expansion chamber 20 and the gun 1. Sealing members 49*a*, 49*b*, 49*c* provide a seal between baffles 33*a*, 33*b*, 33*c* and housing 25 to force the fluid flow as described next.

In operation, fluid flows through expansion chamber 20 as follows, although innumerable baffle configurations (or no baffles) could be created without departing from the present invention. Fluid enters expansion chamber 20 through inlet 26 in base 22. Fluid continues through cross bore 51, axial bore 52 and exits baffle assembly 35 through cross bore 53. Fluid continues through notches 54*a*, 54*b* in baffles 33*b*, 33*c*. Finally, fluid flows through cross bore 55 and axial bore 36 in baffle assembly 35, exiting through outlet 27 of the expansion chamber 20.

As shown in FIG. 1, a pneumatic gun comprises a gun housing 2 containing a firing mechanism (not shown) for firing a projectile. The firing mechanism is powered by a volume of compressed gas supplied from a compressed gas source (not shown). The compressed gas source (not shown) attaches to an air source adapter 60, which is in communication with linkage 62. Linkage 62 is attached to inlet 26 of expansion chamber 20. Expansion chamber 20 is attached to gun housing 2. Gun housing 2 attaches to barrel assembly 10.

While the invention has been particularly shown and described with reference to a particular embodiment thereof, it will be understood by those skilled in the art that various changes in form and detail may be made therein without departing from the spirit and scope of the invention. The present example and embodiment, therefore, are to be considered in all respects as illustrative and not restrictive, and the invention is not to be limited to the details given herein.

What is claimed is:

1. A barrel for a gun comprising:

a rigid member defining an axial bore and attaching to a firing mechanism for launching a projectile along the axial bore, the member being substantially transparent.

2. The barrel of claim 1, wherein the substantially transparent material is comprised of a polycarbonate.

3. The barrel of claim 1, wherein the substantially transparent material is comprised of tempered glass.

4. The barrel of claim 3, wherein the tempered glass is coated with a substantially transparent material.

5. The barrel of claim 2, wherein the polycarbonate is coated with a material comprised of silicon.

6. The barrel of claim 4, wherein the tempered glass is coated with a material comprised of a polymer.

7. The barrel of claim 1, wherein the member substantially comprises the substantially transparent material.

8. The barrel of claim 1, wherein a cage defines a partially cut pattern to partially encase a portion of the diameter of the member.

9. A gun comprising:

a mechanism for firing a projectile; and a rigid barrel defining an axial bore and attaching to the firing mechanism for launching the projectile along the axial bore, the barrel being substantially transparent.

10. The gun of claim 9, wherein the firing mechanism attaches to a first end of the barrel and a second end of the barrel is adapted to receive a muzzle.

11. The gun of claim 9, wherein the firing mechanism attaches to a first end of the barrel and a second end of the barrel is adapted to receive a muzzle, the muzzle having slots for escaping air.

12. A barrel for a gun comprising:

a rigid member defining an axial bore and attaching to a firing mechanism for launching a projectile along the axial bore to expel the projectile in a direction substantially parallel to the axial bore, the member being substantially transparent.

13. The barrel of claim 12, wherein the firing mechanism is powered by a volume of compressed gas.

14. The barrel of claim 12, wherein a cage partially encases a portion of the member proximate to the firing mechanism.

15. The barrel of claim 12, wherein a cage partially encases a portion of the member, the member remaining substantially visible.

* * * * *